US008803437B2

(12) United States Patent
Hsieh

(10) Patent No.: US 8,803,437 B2
(45) Date of Patent: Aug. 12, 2014

(54) SWITCHING MODE PULSED CURRENT SUPPLY FOR DRIVING LEDS

(76) Inventor: Wen-Hsiung Hsieh, Keelung (TW)

( * ) Notice: Subject to any disclaimer, the term of this patent is extended or adjusted under 35 U.S.C. 154(b) by 310 days.

(21) Appl. No.: 13/244,487

(22) Filed: Sep. 25, 2011

(65) Prior Publication Data

US 2013/0076257 A1 Mar. 28, 2013

(51) Int. Cl.

| | |
|---|---|
| ***H05B 41/16*** | (2006.01) |
| ***H05B 41/24*** | (2006.01) |
| *H05B 37/02* | (2006.01) |
| *H05B 39/02* | (2006.01) |
| *H05B 39/04* | (2006.01) |
| *H05B 41/36* | (2006.01) |

(52) U.S. Cl.
USPC ..... 315/254; 315/209 R; 315/246

(58) Field of Classification Search
None
See application file for complete search history.

(56) References Cited

U.S. PATENT DOCUMENTS

| | | | |
|---|---|---|---|
| 6,304,464 | B1 | 10/2001 | Jacobs |
| 6,577,072 | B2 | 6/2003 | Saito |
| 6,577,512 | B2 | 6/2003 | Tripathi |
| 6,747,420 | B2 | 6/2004 | Barth |
| 6,826,059 | B2 | 11/2004 | Böckle |
| 7,071,630 | B1 | 7/2006 | York |
| 7,245,089 | B2 | 7/2007 | Yang |
| 7,259,525 | B2 | 8/2007 | Yang |
| 7,378,805 | B2 | 5/2008 | Oh |
| 7,439,945 | B1 | 10/2008 | Awalt |
| 7,463,070 | B2 | 12/2008 | Wessels |
| 7,557,521 | B2 | 7/2009 | Lys |
| 7,579,786 | B2 | 8/2009 | Soos |
| 7,633,463 | B2 | 12/2009 | Negru |
| 7,688,009 | B2 | 3/2010 | Bayadroun |
| 7,710,047 | B2 | 5/2010 | Shteynberg |
| 7,746,300 | B2 | 6/2010 | Zhang |
| 7,750,616 | B2 | 7/2010 | Liu |
| 7,843,147 | B2 | 11/2010 | Chenetz |
| 7,880,404 | B2 | 2/2011 | Deng |
| 7,888,881 | B2 | 2/2011 | Shteynberg |
| 8,040,102 | B2 | 10/2011 | Kao |
| 8,120,201 | B2 | 2/2012 | Fujino |
| 8,203,283 | B2 | 6/2012 | Hoogzaad |
| 8,212,490 | B2 | 7/2012 | Ikegami |
| 2010/0019696 | A1* | 1/2010 | Kimura ..... 315/297 |

* cited by examiner

*Primary Examiner* — Douglas W Owens
*Assistant Examiner* — Dedei K Hammond

(57) ABSTRACT

A method of switching a plurality of switches for supplying a pulsed current to one or more than one light-emitting diodes involves: switching a current from a direct current (DC) voltage to an inductance component, for example an inductor or a flyback transformer, for charging the inductance component; switching a current from the inductance component to the light-emitting diodes for transferring energy from the inductance component to the light-emitting diodes; switching a current from the inductance component to the direct current (DC) voltage for transferring energy from the inductance means back to the direct current (DC) voltage; controlling the switchings to regulate the current in the inductance component for supplying the pulsed current to the light-emitting diodes is disclosed.

16 Claims, 3 Drawing Sheets

SWITCHING MODE PULSED CURRENT SUPPLY FOR DRIVING LEDS

TECHNICAL FIELD

The technical field of this disclosure is switching mode pulsed current regulator circuits, particularly, a pulsed current regulator circuit for supplying a pulsed current to one or more than one light-emitting diodes.

BACKGROUND OF THE INVENTION

Significant advances have been made in the technology of white light-emitting diodes. White light-emitting diodes are commercially available which generate 60~100 lumens/watt. This is comparable to the performance of fluorescent lamps; therefore there have been a lot of applications in the field of lighting using white light-emitting diodes.

Various light-emitting diode driver circuits are known from the prior arts. For example, U.S. Pat. No. 6,304,464: "FLYBACK AS LED DRIVER"; U.S. Pat. No. 6,577,512: "POWER SUPPLY FOR LEDS"; and U.S. Pat. No. 6,747,420: "DRIVER CIRCUIT FOR LIGHT-EMITTING DIODES". All the light-emitting diode driver circuits mentioned above are constant current regulator circuits that act as constant current sources to drive light-emitting diodes.

In the field of lighting applications, for a white light-emitting diode lamp driven by a constant current source and a fluorescent lamp driven by an alternating current source under the condition that both lamps' remitted illumination have the same average illumination value, the fluorescent lamp provides higher perceived brightness levels than the white light-emitting diode lamp, the main reason is: human eyes are responsive to the peak value of illumination; therefore, if a lamp can provide higher peak illumination, it provides higher perceived brightness levels. For a fluorescent lamp driven by an alternating current (AC) source, it remits illumination with peak value higher than its average illumination value. But for a white light-emitting diode lamp driven by a constant current source, since light generation of a white light-emitting diode is dependent on the current strength through the white light-emitting diode, it remits illumination with peak value close to its average illumination value. Therefore, a white light-emitting diode lamp driven by a constant current regulator circuit constitutes a drawback of its remitted illumination with low perceived brightness levels.

It would be desirable to have a light-emitting diode driving circuit that would overcome the above disadvantages.

SUMMARY OF THE INVENTION

One aspect of the present invention provides a method of supplying a pulsed current to one or more than one light-emitting diodes from a direct current (DC) voltage comprising the steps of: charging an inductance means via switching on a current from the direct current (DC) voltage to the inductance means; discharging the inductance means via switching off the current from the direct current (DC) voltage to the inductance means, and switching on a current from the inductance means either to said light-emitting diodes for transferring energy from the inductance means to said light-emitting diodes or to the direct current (DC) voltage for transferring energy back to the direct current (DC) voltage; controlling said charging and discharging to regulate the current in the inductance means for supplying a pulsed current to said light-emitting diodes.

Accordingly, since light generation of a white light-emitting diode is dependent on the current strength through the white light-emitting diode, to drive a white light-emitting diode with a pulsed current can remit illumination with higher peak illumination value to provide higher perceived brightness levels than to drive it with a constant current, the switching mode pulsed current supply disclosed by this application provide a better solution for driving light emitting diodes.

The foregoing and other features and advantages of the invention will become further apparent from the following detailed description of the presently preferred embodiments, read in conjunction with the accompanying drawings. The detailed description and drawings are merely illustrative of the invention, rather than limiting the scope of the invention.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION OF THE PREFERRED EMBODIMENTS

The detailed description set forth below in connection with the appended drawings is intended as a description of presently preferred embodiments of the invention and is not intended to represent the only forms in which the present invention may be constructed and or utilized.

Figure 1:
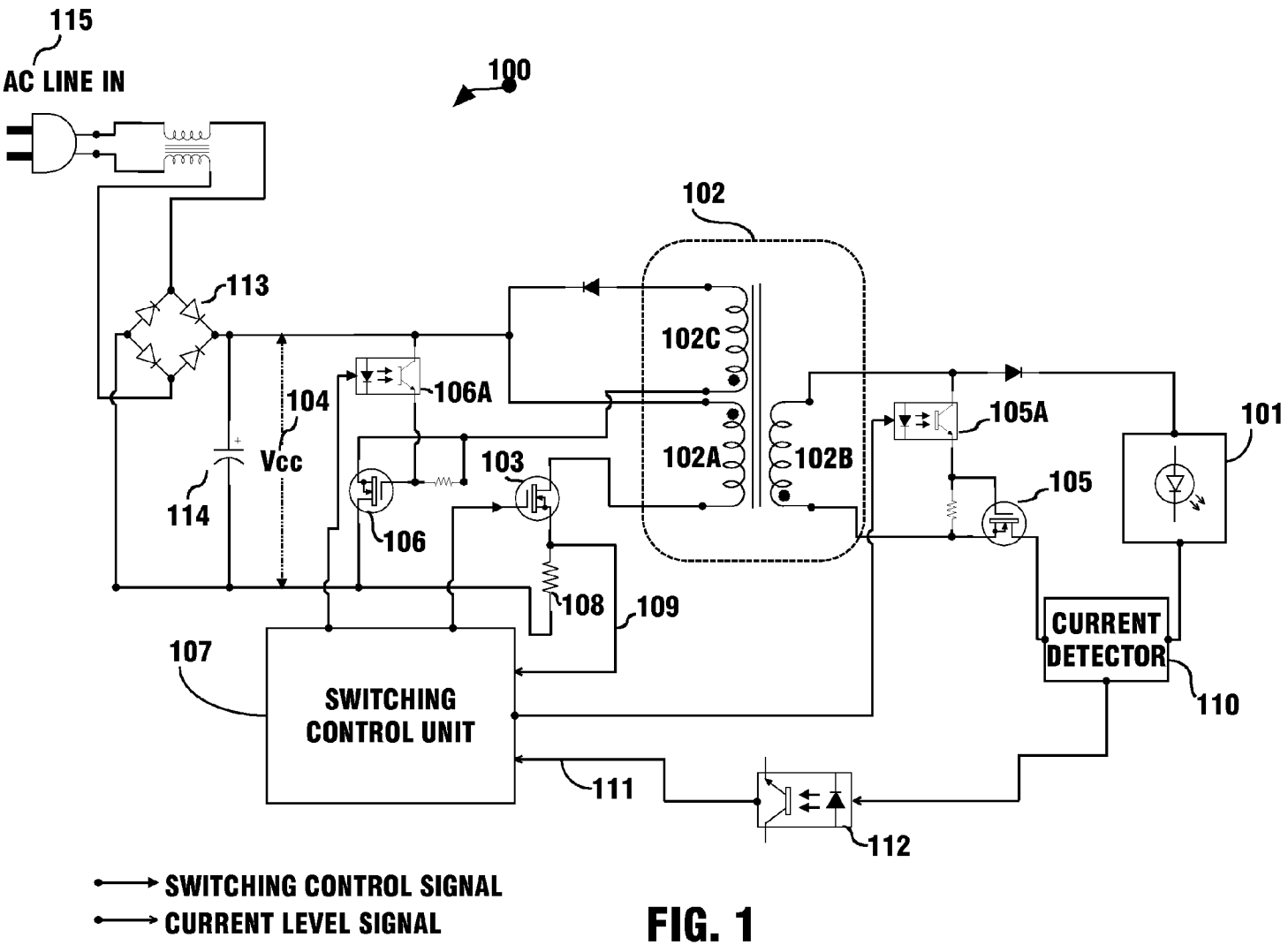
FIG. 1 is a block and circuit diagram illustrating an exemplary embodiment of a switching mode pulsed current supply according to the invention, wherein the inductance means is a flyback transformer.

FIG. 1 is a block and circuit diagram illustrating an exemplary embodiment of a switching mode pulsed current supply according to the invention, wherein the inductance means is a flyback transformer.

As illustrated in FIG. 1, a switching mode pulsed current supply 100 for supplying a pulsed current to one or more than one light-emitting diodes 101 is disclosed, said circuit comprising: an inductance means 102; a first switching unit 103 coupled to the inductance means 102 for switching a current from a direct current (DC) voltage 104 to the inductance means 102; a second switching unit 105 coupled between the inductance means and said light-emitting diodes 101 for switching a current from the inductance means 102 to said light-emitting diodes 101; a third switching unit 106 coupled between the inductor inductance 102 and the direct current (DC) voltage 104 for switching a current from the inductance means 102 to the direct current (DC) voltage 104; an switching control unit 107 coupled to said switching units 103, 105, 106 to control their switching for supplying a regulated pulsed current to said light-emitting diodes 101.

As further illustrated in FIG. 1, the inductance means 102 is a flyback transformer comprising a primary winding 102A, a first secondary winding 102B coupled to said light-emitting diodes 101 and a second secondary winding 102C coupled to the direct current (DC) voltage 104. The switching control unit 107 coupled to the second switching unit 105 through a photo coupler 105A and coupled to the third switching unit 106 through a photo coupler 106A to control their switching FIG. 2 are exemplary waveform diagrams illustrating the various waveforms at different points of circuits in FIG. 1 and FIG. 3 in accordance with the present invention.

Figure 2:
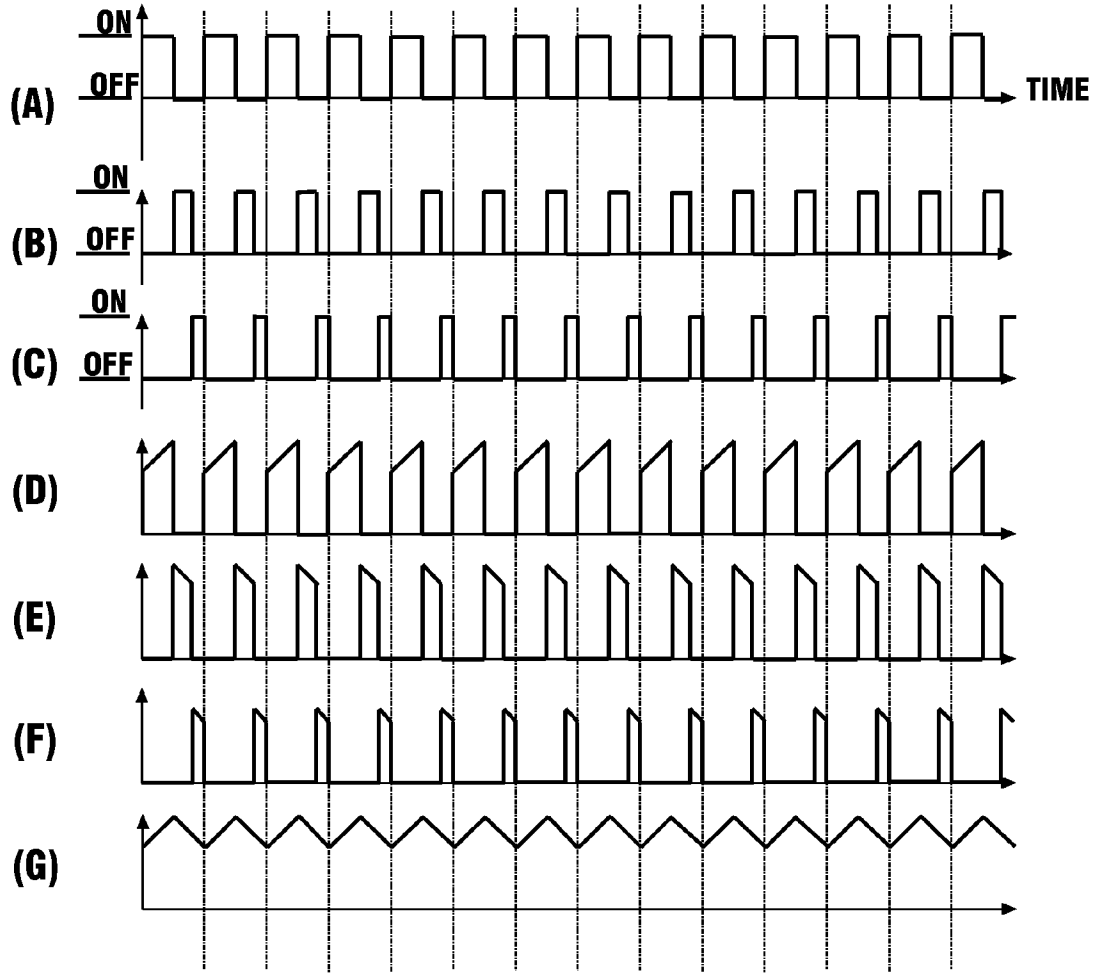
FIG. 2 are exemplary waveform diagrams illustrating the various waveforms at different points of circuits in FIG. 1 and FIG. 3 in accordance with the present invention.

As illustrated in FIG. 1 and FIG. 2, a non-limiting exemplary waveform of switching control signals from the switching control unit 107 to the first switching unit 103 for controlling their switching are illustrated in FIG. 2(A); a non-limiting exemplary waveform of switching control signal from the switching control unit 107 to second switching unit 105 for controlling its switching is illustrated in FIG. 2(B); and a non-limiting exemplary waveform of switching control signal from the switching control unit 107 to third switching unit 106 for controlling its switching are illustrated in FIG. 2(C). According to the switching control signals from the switching control unit 107 to the switching units 103, 105 and 106 illustrated in FIGS. 2(A), 2(B) and 2(C), a non-limiting exemplary waveform of a current from the direct current (DC) voltage 104 to the primary winding 102A is illustrated in FIG. 2(D); a non-limiting exemplary waveform of a current from the first secondary winding 102B to said light-emitting diodes 101 is illustrated in FIG. 2(E); a non-limiting exemplary waveform of a current from the second secondary winding 102C to the direct current (DC) voltage 104 is illustrated in FIG. 2(F).

Accordingly, as further illustrated in FIG. 1 and FIG. 2, the switching units 103, 105 and 106 switch to charge and discharge the inductance means 102 for providing a pulsed current: when the first switching unit 103 switches on and the switching units 105 and 106 switch off, the inductance means 102 is charging energy from the direct current (DC) voltage 104; further when the second switching unit 105 switches on and the switching units 103 and 106 both switch off, the energy stored in inductance means 102 is discharged to said light-emitting diodes 101; further when the third switching unit 106 switches on and the switching units 103 and 105 both switch off, the energy stored in inductance means 102 is discharged back to the direct current (DC) voltage 104. Therefore, at steady state, the energy flow in and out of the inductance means 102 are determined according to the duty ratio between the switching units 103, 105 and 106 during each switching periods, therefore, the switching of the switching units 103, 105 and 106 regulates the current in the inductance means 102 for supplying a pulsed current illustrated in FIG. 2(E) to said light-emitting diodes 101. Accordingly, the pulse width of the pulsed current is controllable, since the duty ratio between the switching units 105 and 106 is adjustable.

As further illustrated in FIG. 1, the switching mode pulsed current supply 100 further comprises a negative feedback current signal generator 108 to generate a negative feedback current signal 109 corresponding to the current in the inductance means 102, wherein the switching control unit 107 integrates the negative feedback current signal 109 to process a negative feedback control.

As further illustrated in FIG. 1, the switching mode pulsed current supply 100 further comprises a negative feedback signal generator 110 to generate a negative feedback signal 111 corresponding to the current of said light-emitting diodes 101, wherein the switching control unit 107 integrates the negative feedback signal 111 to process a negative feedback control.

As further illustrated in FIG. 1, the switching mode pulsed current supply 100 further comprises a photo coupler 112 coupled between the negative feedback signal generator 110 and the switching control unit 107 to provide electric isolation between the negative feedback signal generator 110 and the switching control unit 107.

As further illustrated in FIG. 1, the switching mode pulsed current supply 100 further comprises a rectifying unit 113 and a smoothing unit 114 to rectify and smooth an alternating current (AC) voltage 115 and to provide the direct current (DC) voltage 104, wherein the rectifying unit 113 is a full bridge rectifier and the smoothing unit 114 is a capacitor.

Figure 3:
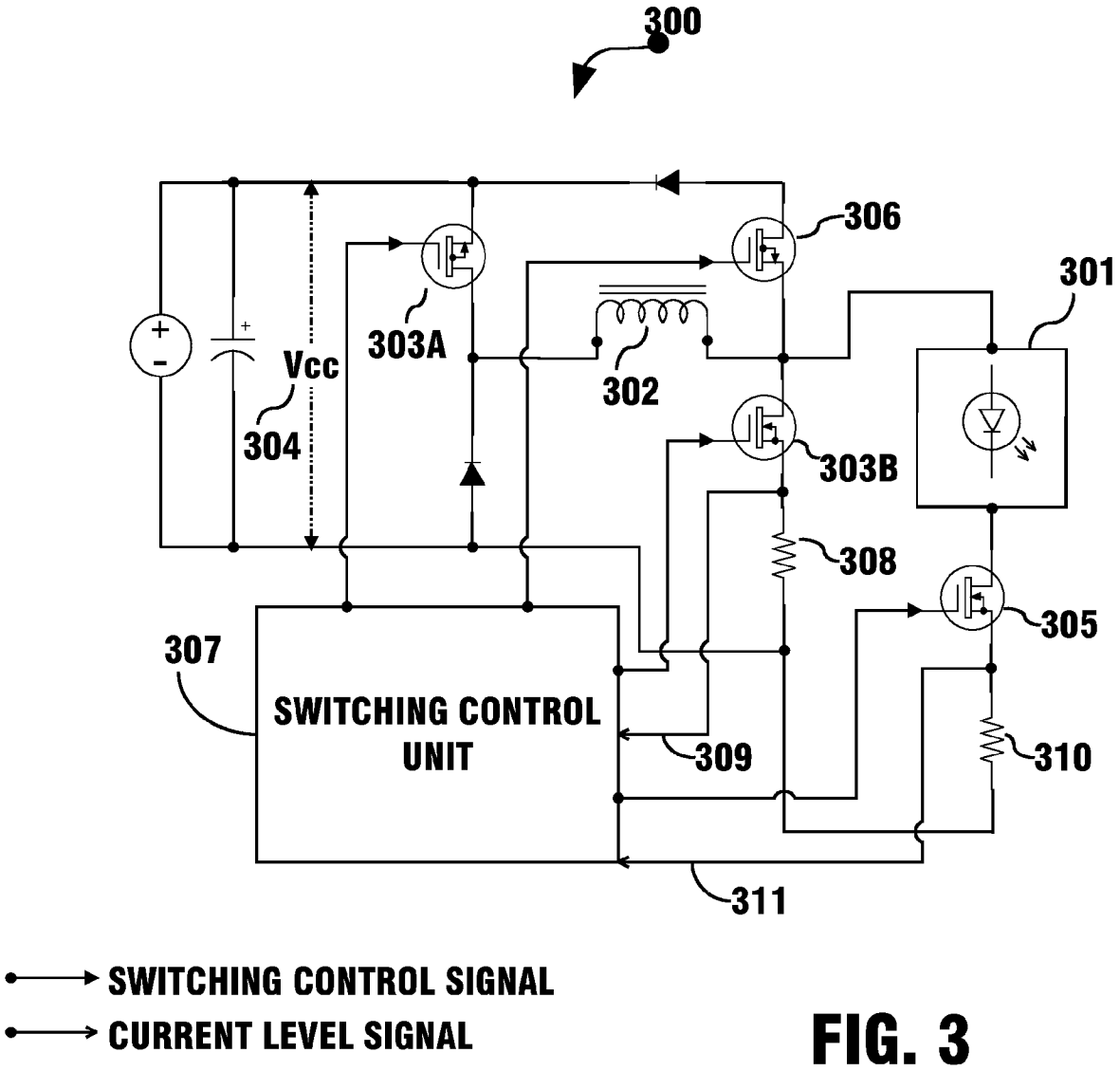
FIG. 3 is a block and circuit diagram illustrating an exemplary embodiment of a switching mode pulsed current supply according to the invention, wherein the inductance means is an inductor.

FIG. 3 is a block and circuit diagram illustrating an exemplary embodiment of a switching mode pulsed current supply according to the invention, wherein the inductance means is an inductor.

As illustrated in FIG. 3, a switching mode pulsed current supply 300 for supplying a pulsed current to one or more than one light-emitting diodes 301 is disclosed, said circuit comprising: an inductance means 302; a first switching unit 303 comprising switches 303A and 303B coupled to the inductance means 302 for switching a current from a direct current (DC) voltage 304 to the inductance means 302; a second switching unit 305 coupled to said light-emitting diodes 301 for switching a current from the inductance means 302 to said light-emitting diodes 301; a third switching unit 306 coupled between the inductance means 302 and the direct current (DC) voltage 304 for switching a current from the inductance means 302 to the direct current (DC) voltage 304; an switching control unit 307 coupled to said switching units 303, 305, 306 to control their switching for supplying a regulated pulsed current to said light-emitting diodes 301.

As further illustrated in FIG. 3, the inductance means 302 is an inductor.

FIG. 2 shows exemplary waveform diagrams illustrating the various waveforms at different points of circuits in FIG. 3 in accordance with the present invention.

As illustrated in FIG. 3 and FIG. 2, a non-limiting exemplary waveform of switching control signals from the switching control unit 307 to the first switching unit 303 comprising switches 303A, 303B for controlling their switching is illustrated in FIG. 2(A); a non-limiting exemplary waveform of switching control signal from the switching control unit 307 to second switching unit 305 for controlling its switching is illustrated in FIG. 2(B); and a non-limiting exemplary waveform of switching control signal from the switching control unit 307 to third switching unit 306 for controlling its switching is illustrated in FIG. 2(C). According to the switching control signals from the switching control unit 307 to the switching units 303, 305 and 306 illustrated in FIGS. 2(A), 2(B) and 2(C), a non-limiting exemplary waveform of a current from the direct current (DC) voltage 304 to the inductor 302 is illustrated in FIG. 2(D); a non-limiting exemplary waveform of a current from the inductor 302 to said light-emitting diodes 301 is illustrated in FIG. 2(E); a non-limiting exemplary waveform of a current from the inductor 302 back to the direct current (DC) voltage 304 is illustrated in FIG. 2(F); a non-limiting exemplary waveform of a current in the inductor 302 is illustrated in FIG. 2(G).

Accordingly, as further illustrated in FIG. 3 and FIG. 2, the switching units 303, 305 and 306 switch to charge and discharge the inductor 302 for providing a pulsed current to said light-emitting diodes 301: when the first switching unit 303 switches on and the switching units 305 and 306 switch off, the inductor 302 is charging energy from the direct current (DC) voltage 304; further when the second switching unit 305 switches on and the switching units 303 and 306 both switch off, the energy stored in the inductor 302 is discharged to said light-emitting diodes 301; furthermore when the third switching unit 306 switches on and the switching units 303 and 305 both switch off, the energy stored in the inductor 302 is discharged back to the direct current (DC) voltage 304. Therefore, at steady state, the energy flow in and out of the inductor 302 are determined according to the duty ratio between the switching units 303, 305 and 306 during each switching periods, therefore, this switching regulates the current in the inductor 302 for supplying a pulsed current illustrated in FIG. 2(E) to said light-emitting diodes 301. Accordingly, the pulse width of the pulsed current is controlled according to the duty ratio between the switching units 305 and 306.

As further illustrated in FIG. 3, the switching mode pulsed current supply 300 further comprises a negative feedback current signal generator 308 to generate a negative feedback current signal 309 corresponding to the current in the inductance means 302, wherein the switching control unit 307 integrates the negative feedback current signal 309 to process a negative feedback control.

As further illustrated in FIG. 3, the switching mode pulsed current supply 300 further comprises a negative feedback signal generator 310 to generate a negative feedback signal 311 corresponding to the current of said light-emitting diodes 301, wherein the switching control unit 307 integrates the negative feedback signal 311 to process a negative feedback control.

Accordingly, since light generation of a white light-emitting diode is dependent on the current strength through the white light-emitting diode, to drive a white light-emitting diode with a pulsed current can remit illumination with higher peak illumination value to provide higher perceived brightness levels than to drive it with a constant current, the switching mode pulsed current supplies 100, 300 provide a better solution for driving light emitting diodes.

It is to be understood that the above described embodiments are merely illustrative of the principles of the invention and that other arrangements may be devised by those skilled in the art without departing from the spirit and scope of the invention.

What is claimed is:

1. A method of supplying a pulsed current to one or more than one light-emitting diodes comprising:

switching a first current from a direct current (DC) voltage to an inductance means for charging the inductance means;

switching the pulsed current from the inductance means to said light-emitting diodes for discharging the inductance means to said light-emitting diodes;

switching a second current from the inductance means to the direct current (DC) voltage for discharging the inductance means to the direct current (DC) voltage;

wherein switching the first current from the direct current (DC) voltage to the inductance means, switching the pulsed current from the inductance means to said light-emitting diodes, and switching the second current from the inductance means to the direct current (DC) voltage are controlled to regulate the pulsed current.

2. The method of claim 1 further comprising:

getting a feedback current signal by detecting the current of the inductance means and integrating the feedback current signal to process a negative feedback control.

3. The method of claim 1 further comprising:

getting a feedback signal by detecting the current of said light-emitting diodes and integrating the feedback signal to process a negative feedback control.

4. The method of claim 2 further comprising:

getting a feedback signal by detecting the current of said light-emitting diodes and integrating the feedback signal to process a negative feedback control.

5. The method according to claim 1, wherein the inductance means comprises an inductor or a flyback transformer.

6. The method according to claim 5, wherein the flyback transformer comprises:

a primary winding for charging the flyback transformer;

a first secondary winding for discharging the flyback transformer to said light-emitting diodes;

a second secondary winding for discharging the flyback transformer to the direct current (DC) voltage.

7. A circuit for supplying a pulsed current to one or more than one light-emitting diodes, said circuit comprising:

an inductance means;

a first switching unit comprising at least one switch and coupled to the inductance means for switching a first current from a direct current (DC) voltage to the inductance means for charging the inductance means;

a second switching unit comprising at least one switch and coupled to said light-emitting diodes for switching the pulsed current from the inductance means to said light-emitting diodes;

a third switching unit comprising at least one switch and coupled between the inductance means and the direct current (DC) voltage for switching a second current from the inductance means to the direct current (DC) voltage for discharging the inductance means to the direct current (DC) voltage;

a switching control unit coupled to the first switching unit, the second switching unit and the third switching unit to control their switching for regulating the pulsed current supplied to said light-emitting diodes.

8. The circuit according to claim 7, further comprising:

a negative feedback current signal generator to generate a negative feedback current signal corresponding to the current in the inductance means, wherein the switching control unit integrates the negative feedback current signal to process a negative feedback control.

9. The circuit according to claim 7, further comprising:

a negative feedback signal generator to generate a negative feedback signal corresponding to the current of said light-emitting diodes, wherein the switching control unit integrates the negative feedback signal to process a negative feedback control.

10. The circuit according to claim 8, further comprising:

a negative feedback signal generator to generate a negative feedback signal corresponding to the current of said light-emitting diodes, wherein the switching control unit integrates the negative feedback current signal and the negative feedback signal to process a negative feedback control.

11. The circuit according to claim 8, further comprising:

an isolator circuit coupled between the negative feedback current signal generator and the switching control unit to provide electric isolation between the negative feedback current signal generator and the switching control unit.

12. The circuit according to claim 9, further comprising:

an isolator circuit coupled between the negative feedback signal generator and the switching control unit to provide electric isolation between the negative feedback signal generator and the switching control unit.

13. The circuit according to claim 10, further comprising:

an isolator circuit coupled between the negative feedback signal generator and the switching control unit to provide electric isolation between the negative feedback signal generator and the switching control unit.

14. The circuit according to claim 7, further comprising:

a rectifying and smoothing unit to rectify and smooth an alternating current (AC) voltage for providing the direct current (DC) voltage.

15. The circuit according to claim 7, wherein the inductance means comprises an inductor or a flyback transformer.

16. The circuit according to claim 15, wherein the flyback transformer comprises:

a primary winding for charging the flyback transformer;

a first secondary winding for discharging the flyback transformer to said light-emitting diodes;

a second secondary winding for discharging the flyback transformer to the direct current (DC) voltage.

* * * * *